US005860367A

United States Patent [19]

Riegel et al.

[11] Patent Number: 5,860,367

[45] Date of Patent: Jan. 19, 1999

[54] FILLETING TABLE

[75] Inventors: Timothy E. Riegel; Jason D. Bartlett, both of Lamar, Mo.

[73] Assignee: R&B Outdoor Products, Inc., Lamar, Mo.

[21] Appl. No.: 108,167

[22] Filed: Jun. 30, 1998

[51] Int. Cl.[6] ..... A47B 85/00

[52] U.S. Cl. ..... 108/26; 452/194

[58] Field of Search ..... 108/24, 25, 26; 452/194; 206/315.11; 43/55

[56] References Cited

U.S. PATENT DOCUMENTS

| | | | |
|---|---|---|---|
| D. 226,603 | 4/1973 | Knighten | D11/1 |
| D. 264,531 | 5/1982 | Trode | D6/179 |
| D. 307,365 | 4/1990 | Dry et al. | D6/429 |
| 692,866 | 2/1902 | Lawrence . | |
| 2,022,591 | 11/1935 | Everitt | 108/24 |
| 2,683,639 | 7/1954 | Brenny | 311/17 |
| 3,713,188 | 1/1973 | Holladay | 17/70 |
| 4,229,858 | 10/1980 | Baxter et al. | 17/44 |
| 4,454,628 | 6/1984 | Olson | 17/44 |
| 4,747,352 | 5/1988 | Guidry et al. | 108/26 |
| 4,846,076 | 7/1989 | Menges, Sr. et al. | 108/42 |
| 4,935,991 | 6/1990 | Tourney | 17/53 |
| 5,460,391 | 10/1995 | Gantz et al. | 108/26 |
| 5,474,494 | 12/1995 | Sims | 452/194 |
| 5,522,765 | 6/1996 | Dotson et al. | 452/196 |
| 5,542,359 | 8/1996 | Polries | 108/26 |
| 5,556,181 | 9/1996 | Bertrand | 108/26 |
| 5,572,934 | 11/1996 | Aldridge et al. | 108/25 |

OTHER PUBLICATIONS

Pro–Fillet Cleaning System, Bass Pro Shops 1998 Fishing Specialist Catalog, p. 247, Windsor, Ontario, Canada, 1998.

Pro Fishin' Deluxe Fish Cleaning Fillet System, Instruction Sheet, Koller Craft Plastic Products, Fenton, MO, Date Unknown, 2 pgs.

*Primary Examiner*—Peter M. Cuono
*Assistant Examiner*—Gerald A. Anderson
*Attorney, Agent, or Firm*—Ray F. Cox, Jr.

[57] ABSTRACT

A portable table for cleaning fish, fowl, and other game. A one-piece molded work tray is mounted on foldable legs and includes a molded-in holding area, a molded-in fillet bowl, a cut-out opening into a trash bag, a recess with a knife and bag storage area covered by a removable cutting board, a guttering system for leading waste from the work surface or the storage area into the trash bag opening, and an apron extending from the guttering system into the trash bag opening to facilitate guiding waste into the trash bag. Slotted knobs are disposed about the trash bag opening to assist in the attachment of the trash bag. The foldable legs of preferably scissors type folding legs with a center brace and chain support. The work tray rest on the top of the unfolded legs. The rim of the work tray contains diagonal cutouts for the legs to pass through so that the folded legs may be stored inside the work tray.

5 Claims, 6 Drawing Sheets

FILLETING TABLE

BACKGROUND OF THE INVENTION

The present invention relates to a table for cleaning fish, fowl and other game, and in particular, to a table which is collapsible and portable.

Various devices have been proposed to assist the sportsman in cleaning fish, fowl, or other game.

Aldridge et al. (U.S. Pat. No. 5,572,934) discloses a table for eating and cleaning seafood. A perforated tabletop is provided with a hatch in the middle covering a waste container suspended under the table.

Polries (U.S. Pat. No. 5,542,359) discloses a portable, collapsible fish cleaning table with an opening in the tabletop through which waste can be dumped into a receptacle suspended below the tabletop. The table is provided with scissor-type folding legs and a fish clamp on the work surface.

A device known as the Pro-Fillet Fish Cleaning System may be used on the lap or may be fitted with 2×4 legs to form a table. It comprises a one-piece molded plastic surface with a cutting surface, a trough or gutter leading to an opening for a trash bag, and a storage slot for a knife. The device is not known to provide a holding area, any means for sharpening a knife, any provision for a fillet bowl or the like, or provision for a removable cutting board.

U.S. Pat. No. 2,683,639 issued to Brenny on Jul. 13, 1954 for "Foldable Utility Table with Laterally Extensible Leg Means" discloses a table with foldable legs, cut-outs on either side of the table for receiving two covered pans, and a central opening for access to a refuse receptacle.

U.S. Design Pat. No. Des. 307,365 issued to Dry et al. on Apr. 24, 1990 for "Fish Cleaning Table" discloses a design similar to Brenny in that two covered bowls are set in cut-outs in the surface of a table with folding legs.

U.S. Design Pat. No. Des. 264,531 issued to Trode on May 25, 1982 for "Portable Fish Filleting Table" also discloses a table with folding legs, a cutting surface, and an opening in the cutting surface for what may be a refuse receptacle. The refuse receptacle appears to act as a support for one end of the table.

U.S. Design Pat. No. Des. 226,603 issued to Knighten on Apr. 3, 1973 for "Folding Table for Cleaning Fish and Small Game" discloses a table with folding legs, a cutting surface and an opening which may be for waste disposal.

U.S. Pat. No. 5,522,765 issued to Dotson et al. on Jun. 4, 1996 for "Fish Cleaning Device" discloses a fish cleaning board. The board is provided with means to grip the fish during the cleaning operation, an opening to a waste receptacle, and a knife sharpener.

U.S. Pat. No. 4,935,991 issued to Tourney on Jun. 26, 1990 for "Fish Cleaning Station and Method of Using the Same" discloses a fish cleaning table of a commercial variety.

U.S. Pat. No. 3,713,188 issued to Holladay on Jan. 30, 1973 for "Fish Filleting and Skinning Board" discloses a fish filleting board.

U.S. Pat. No. 4,454,628 issued to Olson on Jun. 19, 1984 for "Table for Cleaning Fish" discloses a fish cleaning table designed to be suspended from a sink. It discloses a vacuum molded body, a gutter arrangement leading to a drain opening, and means for attaching a trash bag.

U.S. Pat. No. 4,846,076 issued to Menges, Sr. et al. on Jul. 11, 1989 for "Bucket Board and Seat Apparatus" discloses a a molded polyethylene board with a guttering arrangement leading to a waste discharge into a bucket.

U.S. Pat. No. 692,866 issued to Lawrence on Feb. 11, 1902 for "Fish Cutting Table" discloses a commercial device for cleaning fish.

U.S. Pat. No. 4,229,858 issued to Baxter et al. on Oct. 28, 1980 for "Boat-Mounted Fish-Cleaning Tray" discloses a tray for mounting on the side of a boat. It discloses a separate cutting board and an arrangement for allowing waste to run over the side of the boat.

U.S. Pat. No. 5,474,494 issued to Sims on Dec. 12, 1995 for "Fish Cleaning Apparatus" discloses a tray mounted to a waste receptacle.

SUMMARY OF THE INVENTION

The present invention is a portable device to be used by sportsmen for cleaning fish, fowl, and other game. The device is a table comprising a work tray mounted on foldable legs. The work tray is of one-piece molded plastic construction. It includes a molded-in holding area, a molded-in fillet bowl, a cut-out opening into a trash bag, a recess with a knife and bag storage area covered by a removable cutting board, a guttering system for leading waste from the work surface or the storage area into the trash bag opening, and an apron extending from the guttering system into the trash bag opening to facilitate guiding waste into the trash bag. The cutting board may be wood or a plastic material such as PVC. Slotted knobs are disposed about the trash bag opening to assist in the attachment of the trash bag. The foldable legs of preferably scissors type folding legs with a center brace and chain support. The work tray rest on the top of the unfolded legs. The rim of the work tray contains diagonal cutouts for the legs to pass through so that the folded legs may be stored inside the work tray.

In the preferred embodiment, the cutting board is provided with a finger hole for ease in removing the cutting board from the storage area. The cutting board is attached to the work tray with Velcro or similar hook and loop fastening material.

It is therefore an object of the present invention to provide for a filleting table for cleaning fish, fowl or other game which is collapsible and portable.

It is a further object of the present invention to provide for a filleting table having means to facilitate the control and disposal of waste materials.

It is also an object of the present invention to provide for a filleting table having ample storage for knives, waste disposal bags and the like.

These and other objects and advantages of the present invention will be apparent from a consideration of the following detailed description of the preferred embodiments in conjunction with the appended drawings as described following.

DETAILED DESCRIPTION OF THE PREFERRED EMBODIMENTS

Figure 1:
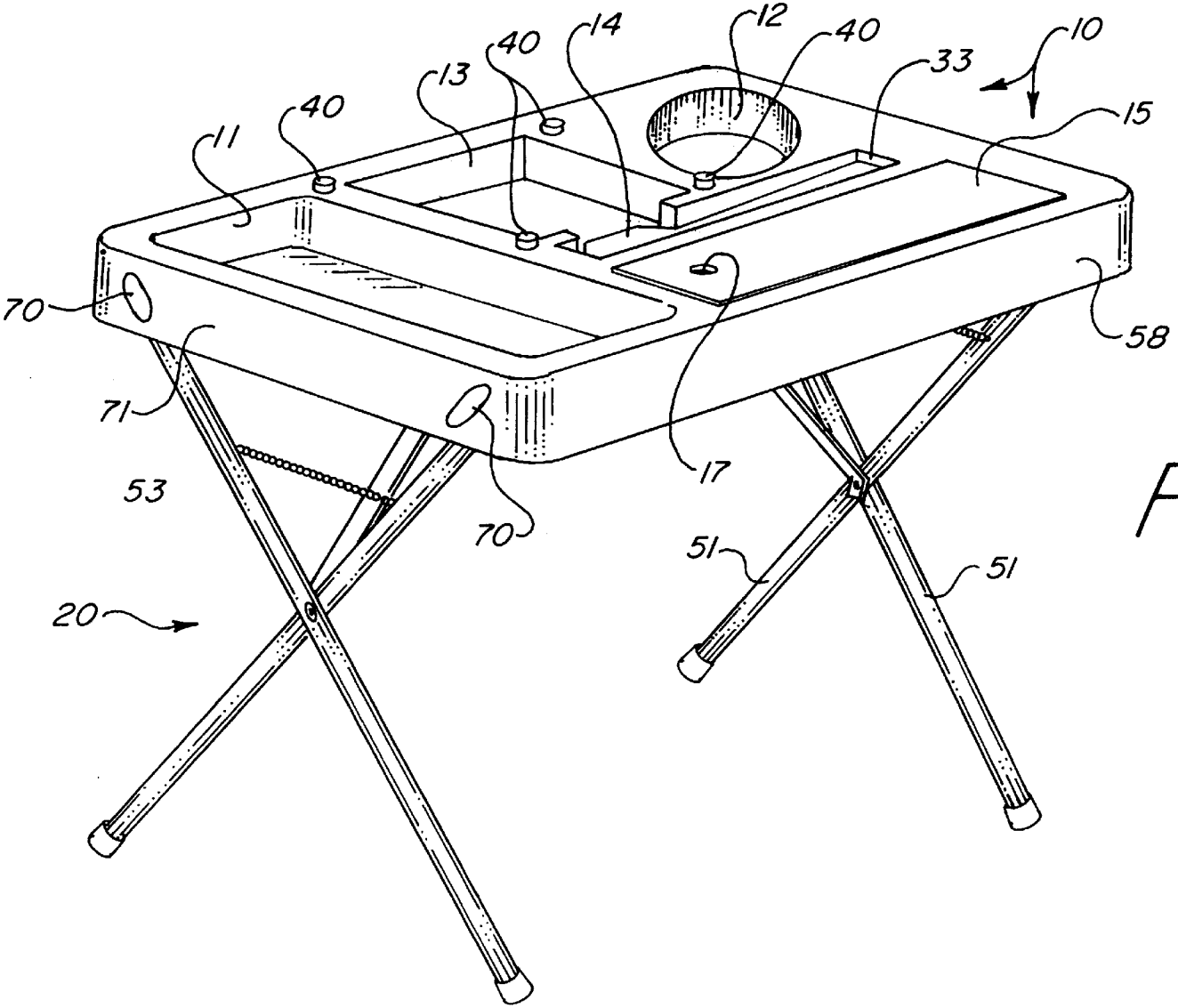
FIG. 1 is a perspective view of the filleting table of the present invention when set up for use.

With reference to FIG. 1 , the preferred embodiment of the present invention may be described. The filleting table of the present invention comprises two major parts: the work tray 10 and foldable legs 20. The work tray 10 is preferably a rotation molded part made of ABS or polystyrene plastic. The foldable legs 20 are preferably scissors style legs that may be folded for storage.

Figure 2:
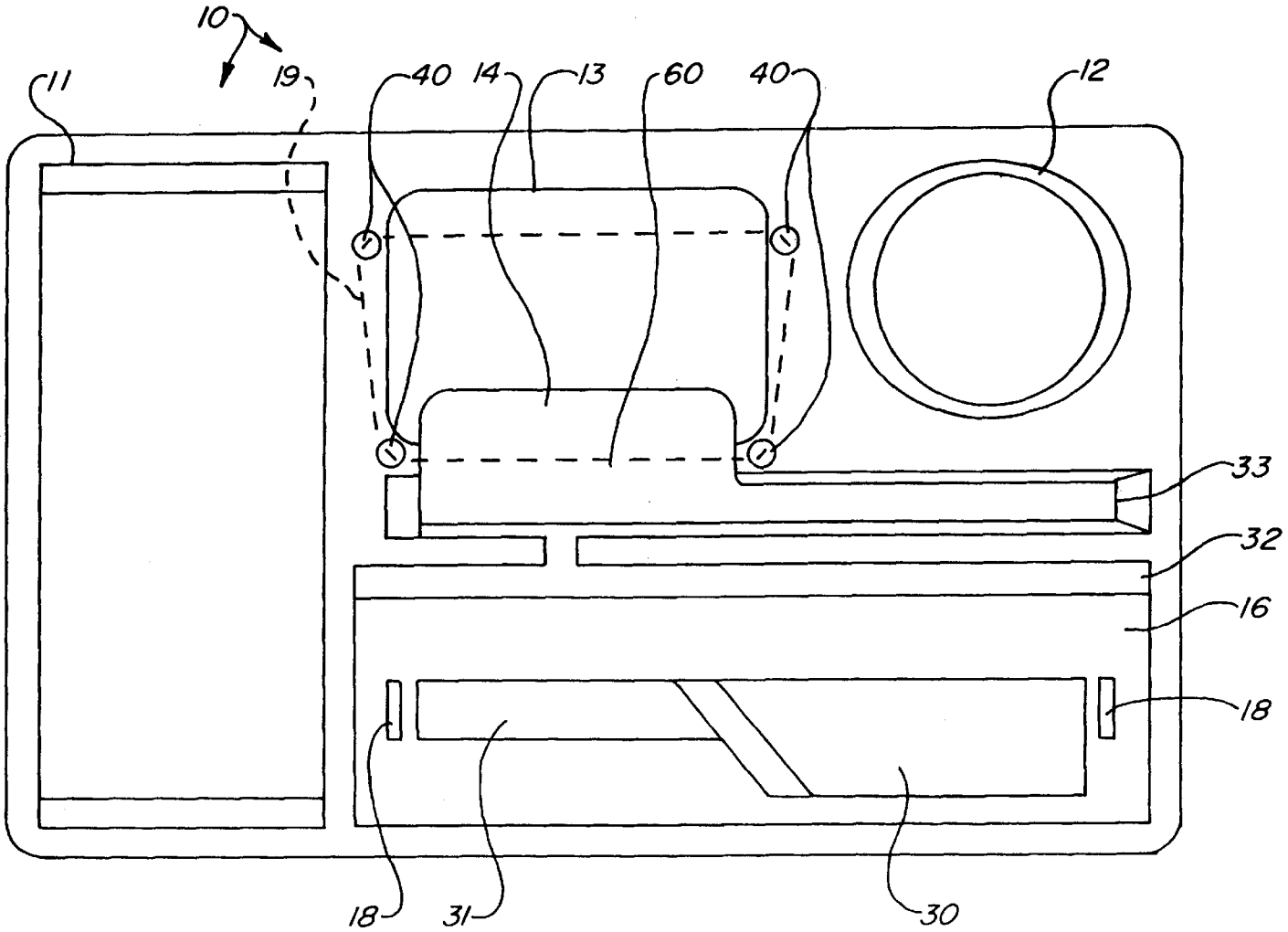
FIG. 2 is a top view of the work tray with the cutting board removed to expose the storage area.

With reference to FIGS. 1 and 2, the work tray 10 comprises a number of molded-in features facilitating the cleaning of fish, fowl or other game. The following description is intended to encompass various types of game, although for brevity's sake, the discussion will refer primarily to fish.

A fish holding area 11 comprises a deep molded-in area for holding fish preparatory to cleaning. A molded-in fillet holding area 12 may be used to hold fillets taken from the cleaned fish. The recessed fillet holding area 12 may also be used to hold a fillet bowl (not shown) or a bag (not shown). A trash bag opening 13 passes completely through the work tray 10. A trash bag 19 (shown in shadow outline) may be placed into the trash bag opening 13 to accept waste derived from cleaning the fish as described more fully below. Furthermore, the an apron 14 extends from the work tray 10 into the trash bag opening 13 to facilitate moving waste material into the trash bag 19. The apron 14 also connects to and cooperates with a guttering system described below to allow the drainage of liquid waste into the trash bag 19.

A removable cutting board 15 fits into a recess 16 so that the surface of the cutting board 15 is flush with the top of the work tray 10. The cutting board 15 is provided with a finger hole 17 to facilitate removal of the cutting board 15 from the recess 16. Hook and loop fastening material 18 is affixed to the bottom of the recess 16 and to matching patches (not shown) on the cutting board 15 to removably attach the cutting board 15 into the recess 16. The cutting board 15 may be of wood or plastic material such as PVC.

Recessed below the bottom of the recess 16 are storage areas 30, 31. The storage areas may be used for various purposes. In the preferred embodiment, storage area 30 is sized 10 to hold the motor/handle of an electric filleting knife, while storage area 31 is sized to hold a number of knife blades. Storage areas 30, 31 may also be used to hold bags, either trash bags for collecting waste for disposal or bags to hold fillets. It should be understood that in the present invention, the size, shape and number of the storage areas are not limited to the particular examples shown herein.

In addition to the storage areas 30, 31, a gutter 32 is recessed below the bottom of the recess 16. The gutter collects any liquid waste that falls around the edges of the cutting board 15. Furthermore, a waste collection trough 33 is provided between the cutting board 15 and the trash bag opening 13 for collecting solid waste produced from the cleaning and filleting of the fish on the cutting board 15. Any such waste may simply be cleared from the surface of the cutting board 15 by raking it into the trough 33. The gutter 32 below the cutting board 15 and the trough 33 are connected by a drain 34. The trough 33 exits onto the apron 14 which projects into the trash bag opening 13. Thus, any solid or liquid waste drains by gravity or is easily raked into the trash bag opening 13, keeping the work tray 10 clean with less danger of waste spilling from the work tray 10.

With reference to FIGS. 1, 2, 5, and 6, the means for holding a trash bag 19 in the trash bag opening 13 may be described. Four knobs 40 are formed into and protrude upward from the surface of the work tray 10. Each knob 40 is provided with a diagonal slot 41 facing away from the trash bag opening 13. In order to attach a trash bag 19 to the work tray 10, the trash bag 19 is placed in the trash bag opening 13 and depending through the trash bag opening 13. The upper edge of the trash bag 19 is drawn up and over each of the knobs 40 so that the upper edge of the trash bag 19 catches in the diagonal slots 41. Due to the elasticity of the trash bag 19, the upper edge of the trash bag 19 contracts into the diagonal slots 41 holding the trash bag 19 firmly in position. It is also significant to note that the trash bag 19 is placed under the apron 14 so that the apron 14 extends over the opening of the trash bag 19 so that any waste ejected from the apron 13 falls into the trash bag 19 and is not spilled over the side. When it is desired to dispose of the trash bag 19, the sequence of steps is reversed to remove the trash bag 19 from the work tray 10.

Figure 3A:
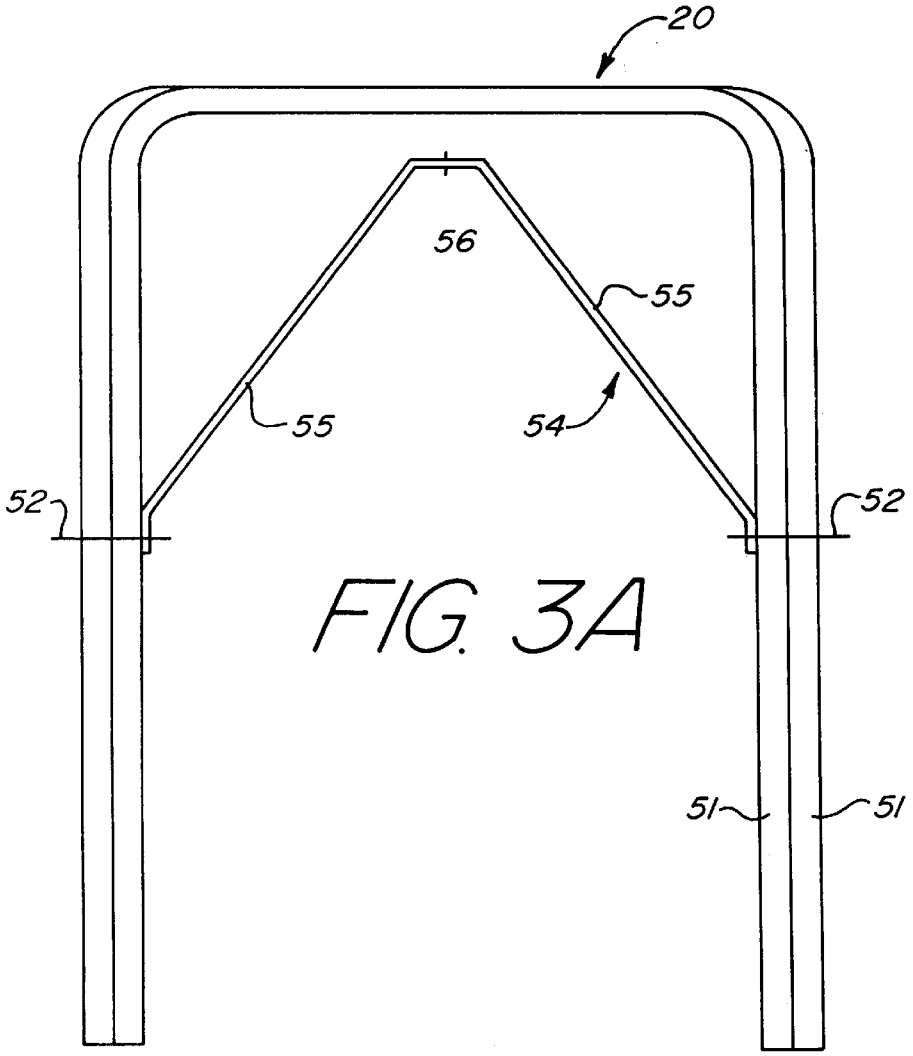
FIG. 3A is a front elevation view of the legs of the table in a folded position.
Figure 3B:
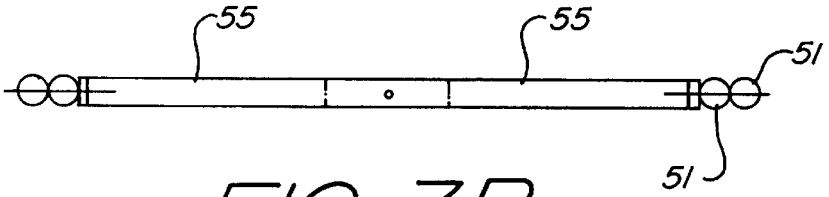
FIG. 3B is a top view of the legs of the table in a folded position.
Figure 3C:
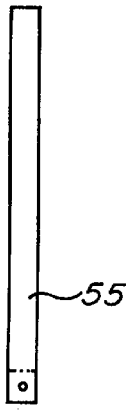
FIG. 3C is a side view of the center brace of the legs.
Figure 4:
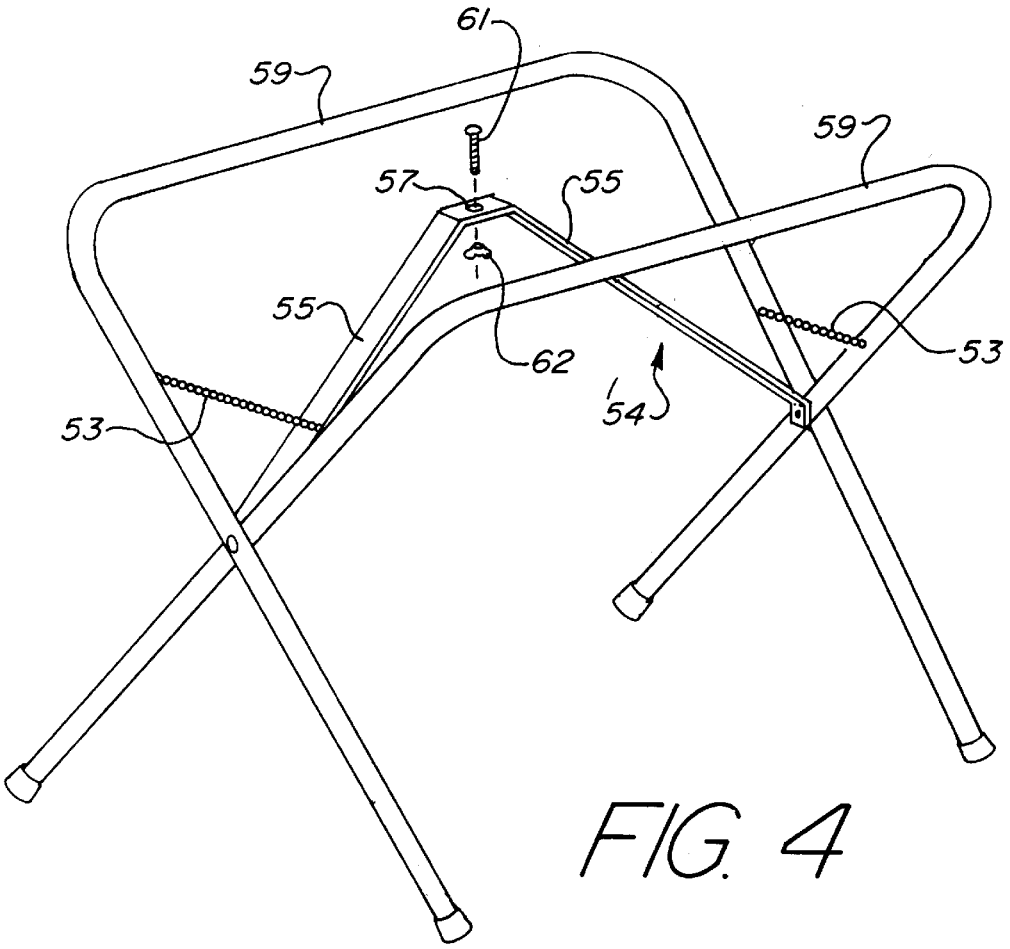
FIG. 4 is a perspective view of the legs in an unfolded position without the work tray in position.
Figure 6:
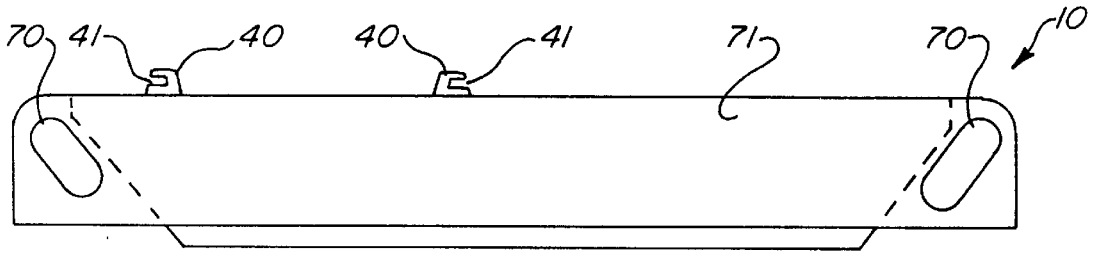
FIG. 6 is a left side elevation of the work tray with the legs removed.
Figure 5:
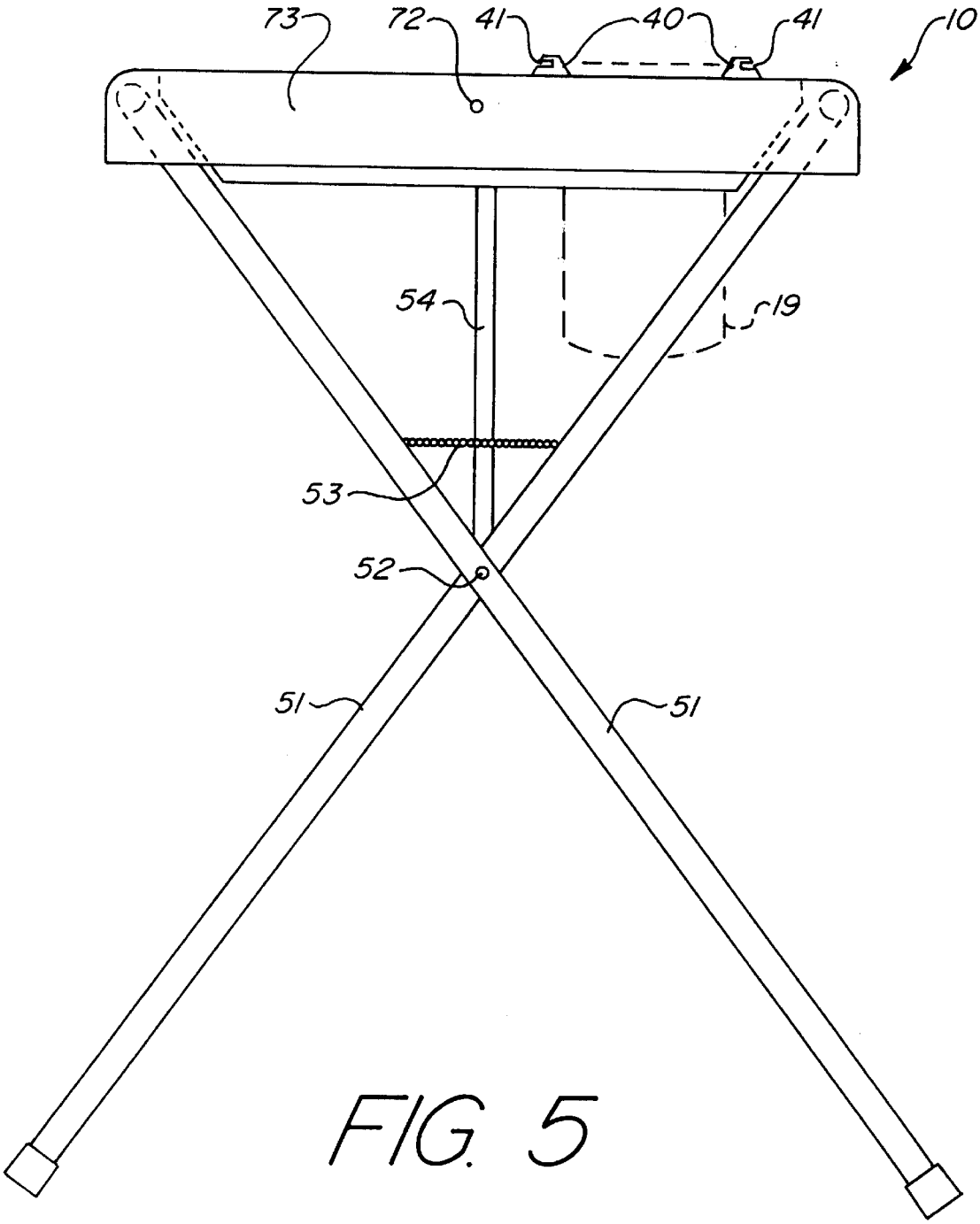
FIG. 5 is right side elevation of the work tray assembled to the legs.
Figure 7:
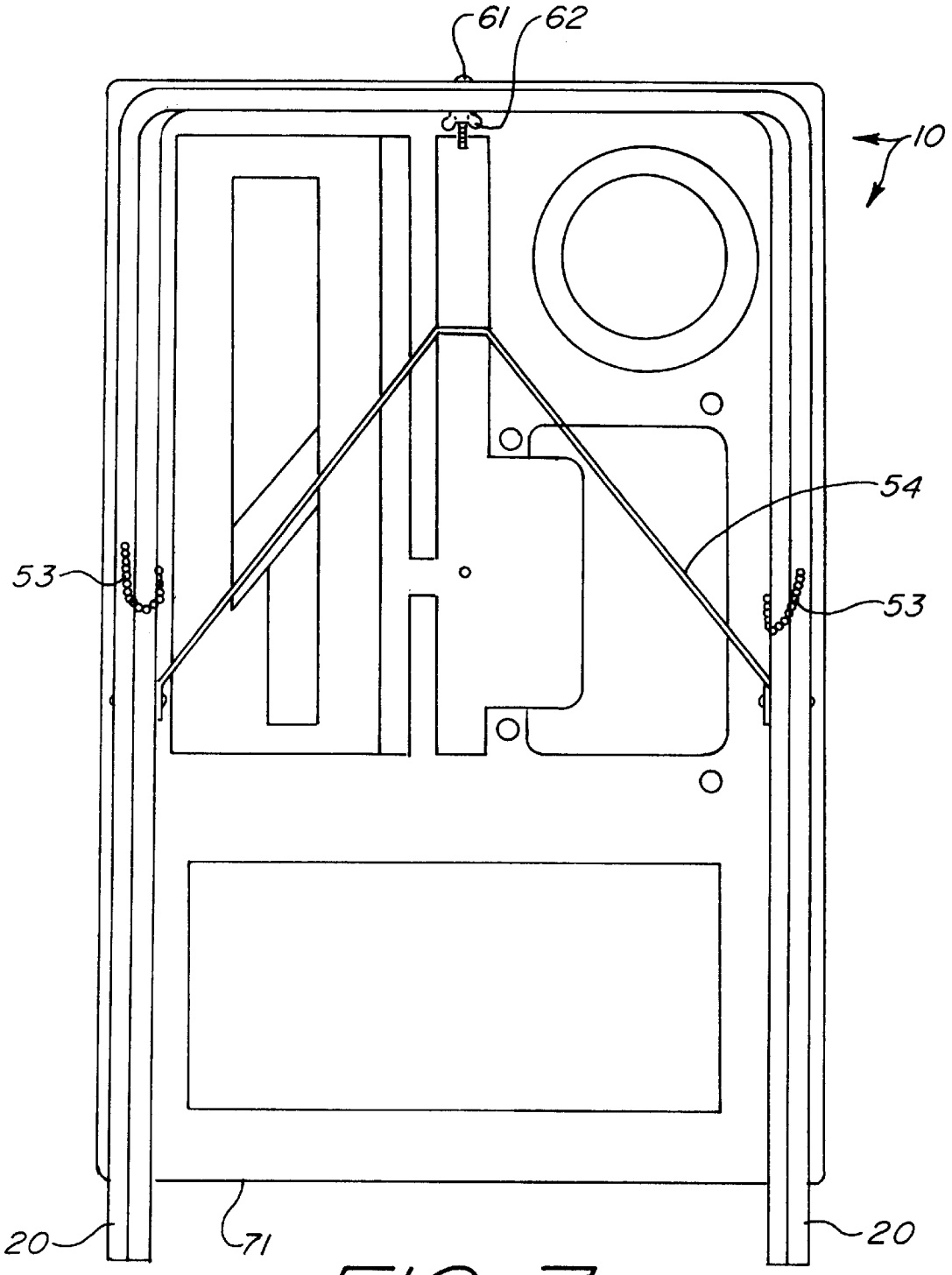
FIG. 7 is a bottom view of the folded legs placed in the work tray for storage.

The folding legs 20 may be described with reference to FIGS. 1, 3A–3C, and 4–7. The folding legs 20 are preferably scissors type in which two U-shaped members 51 pivot about pins 52 so that U-shaped members 51 may be folded into a flat configuration as shown in FIG. 3B or unfolded into an X-shaped configuration when viewed from the side as shown in FIGS. 1, 4, and 5. Members 51 are held in the unfolded X-shaped configuration by chain supports 53, which are attached to respective member 51 above the pivot pins 52.

Folding legs 20 are also provided a center brace 54 that also pivots about pins 52. Center brace 54 has an inverted V-shape wherein each leg 55 of the V-shaped center brace 54 is attached to a respective one of the pivot pins 52 and the vertex 56 of the V-shaped center brace 54 is provided with a vertex hole 57. The work tray 10 is provided with a downwardly depending skirt 58. The work tray 10 is assembled to the unfolded legs 20 by setting the work tray onto the unfolded legs 20 so that the horizontal portions 59 of the members 51 fit within the skirt 58 and support the work tray 10. As shown in FIGS. 2 and 4, the vertex hole 57 in the center brace 54 lines up with a work tray hole 60. A bolt 61 passes through the work tray hole 60 and thence into the vertex hole 57. The bolt 61 is fastened with a wing nut 62, thus fastening the work tray 10 to the legs 20.

In order to fold the filleting table for storage or transportation, the wing nut 62 and bolt 61 are removed and the work tray 10 lifted off the legs 20. The legs are folded to the configuration shown in FIGS. 3A and 3B. In the folded configuration, the legs 20 are slightly longer than the maximum length of the work tray 10. So as to be able to store the folded legs 20 in the work tray 10, a pair of diagonal cutouts 70 are provided in the left side skirt 71 for the legs 20 to pass through. The legs 20 are placed within the skirt 58 of the work tray 10 and are then fastened in storage position using the bolt 61 and wing nut 62 used to hold the center brace in the fully deployed configuration. As shown in FIG. 5, a hole 72 in the right side skirt 73 receives the bolt 61, which passes between the horizontal portions 59 of the members 51 of the legs 20. The wing nut 62 is tightened onto the bolt 61, thus fastening the legs 20 to the work tray 10.

The present invention has been described with reference to certain preferred and alternative embodiments which are intended to be exemplary only and not limiting to the full scope of the present invention as set forth in the appended claims.

What is claimed is:

1. A filleting table for cleaning fish and game animal carcasses, comprising:

a work tray comprising a whole carcass holding area, a removable cutting board, a fillet holding area, an opening for receiving a trash bag, means for supporting the trash bag in said opening, a storage area concealed by said removable cutting board, a gutter positioned under said cutting board for collecting liquid waste produced in cleaning the carcasses, a trough for collecting solid and liquid wastes produced in cleaning the animal carcasses, drain means connecting said gutter to said trough, and an apron extending from said trough into said opening for guiding waste from said trough into said opening; and foldable legs for supporting said work tray.

2. The table of claim 1 wherein said means for supporting the trash bag in said opening comprises a plurality of knobs spaced around said opening and protruding above said work tray, said knobs having slots facing away from said opening for receiving an elastic upper edge of the trash bag.

3. The table of claim 2 wherein said foldable legs comprise a pair of U-shaped members pivotally connected for folding and unfolding in scissors fashion, chain supports connected between said U-shaped members for supporting said foldable legs when unfolded, a center brace pivotally connected to said U-shaped members, and means for removable attachment of said center brace to said work tray.

4. The table of claim 3 wherein said work tray further comprises a skirt depending from said work tray and defining a space for storage of said foldable legs.

5. The table of claim 4 wherein said skirt further comprises cutouts for receiving said foldable legs when stored in said space.

* * * * *